United States Patent [19]

Richmond

[11] 4,330,958

[45] May 25, 1982

[54] GATE-OPENING AND CLOSING ASSEMBLY WITH AUTOMATIC LOCKING MEANS

[76] Inventor: Moscow K. Richmond, 2819 Butler Ave., Los Angeles, Calif. 90066

[21] Appl. No.: 126,315

[22] Filed: Mar. 3, 1980

[51] Int. Cl.[3] ..... E05D 7/06

[52] U.S. Cl. ..... 49/280; 49/340

[58] Field of Search ..... 49/280, 291, 292, 293, 49/295, 296, 298, 340, 345, 346

[56] References Cited

U.S. PATENT DOCUMENTS 2,582,666 1/1952 Young ..... 49/280

3,500,585 3/1970 Vollmar ..... 49/340 X

FOREIGN PATENT DOCUMENTS 2418856 11/1979 France ..... 49/340

*Primary Examiner*—Kenneth Downey

*Attorney, Agent, or Firm*—Robert J. Schaap

[57] ABSTRACT

A gate opening and closing apparatus for shifting a gate hingedly mounted on one of its sides so that an opposite side thereof can be moved to a closed position with respect to a stationary structure or to an open position with respect to this stationary structure. The apparatus comprises a shiftable member as for example, a plate which is mounted on the gate and is shiftable with respect to the side being hinged and the side thereof being located proximate the stationary member when in the closed position. A rod mechanism which is preferably comprised of a plurality of rods is operatively connected to a source of power, as for example, an electric motor, and this rod mechanism is also connected to the shiftable plate. When the motor is energized, the rod mechanism causes the gate to shift, either from an open position to a closed position, or otherwise, from a closed position to an open position. When the rod mechanism shifts the gate to the closed position a locking rod which is operatively connected to the shiftable plate is movable toward the stationary structure and engages a cooperating element so as to lock the gate when in the closed position. The locking rod is moved to the retracted or unlocked position just before the gate starts to move from the closed position to the open position.

12 Claims, 12 Drawing Figures

GATE-OPENING AND CLOSING ASSEMBLY WITH AUTOMATIC LOCKING MEANS

BACKGROUND OF THE INVENTION

1. Field of the Invention

This invention relates in general to certain new and useful improvements in gate opening and closing assemblies, and more particularly, to gate opening and closing assemblies with automatic locking means, and the method of using the same to shift a gate between an open and closed position.

2. Brief Description of the Prior Art

In recent years, there have been a number of gate opening and closing assemblies and particularly, automatic type opening and closing assemblies. These gate assemblies have received increasing prominence in many commercial applications. There are several types of gates which are moved from a closed position to an open position in order to provide access and back to a closed position in order to provide a type of security. One type of gate is a gate which is slidable on a trackway, or other mechanism, for movement in a linear direction. This type of gate shifts from an open position in a linear path to a closed position in order to block the access opening. Other types of gates have one vertical side portion thereof hingedly mounted so that the other vertical side portion is swingable away from a stationary structure to a open position and back toward the stationary structure to a closed position.

As indicated previously, the automatic gate openers, in particular, have received increased prominence in recent years. These automatic gate openers may operate on the basis of a remote central mechanism such that a party desiring to open or close the gate does not have to physically engage the gate. For example, the assembly may use a radio transmitter and receiver system, such that a radio transmitter, when actuated, will generate a particular frequency signal which is sensed by the receiver to automatically operate the gate or door in order to open the same or close the same.

These radio transmitter and receiver systems have been used with various types of gates. Moreover, they have also been used with gates having one vertical side wall hingedly mounted and the other of which moves with respect to the stationary structure.

One of the principal problems encountered with respect to gates having one edge hingedly mounted and which are relatively large is that the free end of the gate which is moved with respect to the stationary structure must be separately locked when the gate has been moved to the closed position. This is particularly true in view of the fact that a relatively large sized gate can be easily "sprung" that is, pried from an unlocked position even when a gate opening and closing assembly exerts a positive locking force thereon. For example, the gate opening and closing assembly may include a rod which shifts the gate from the open position to the closed position and thereby locks the gate at the closed position. However, due to the face that the gate may be fairly large at least with respect to the distance between the hinge axis and the stationary structure, there is an easy mechanical advantage for one unauthorizedly attempting to open the gate against the action of the rod in the gate opening and closing assembly. Thus, there has not been any effective gate opening and closing assembly which opens and closes a gate as well as automatically locks and unlocks the gate simultaneously therewith.

The present invention obviates these and other problems in the provision of a gate opening and closing apparatus which is designed so that it permits a shiftable movement of a hingedly mounted gate from an open position to a closed position and automatically locks the gate at the closed position and automatically unlocks the gate just before shifting the same from the closed to the open position.

OBJECTS OF THE INVENTION

It is, therefore, a primary object of the present invention to provide an improved gate opening and closing apparatus which is designed to shift a gate from an open to a closed position and back from a closed to an open position and automatically provides a locking action when the gate is shifted to a closed position.

It is another object of the present invention to provide an apparatus of the type stated in which the apparatus is uniquely designed to be powered by an electric motor means such that the motor means may be located in a wide variety of positions with respect to the gate.

It is a further object of the present invention to provide an apparatus of the type stated which is highly efficient in its operation and requires a minimum amount of space in order to fully operate a gate for shiftable movement thereof.

It is an additional object of the present invention to provide a gate opening and closing assembly in which a gate is shifted to a closed position by a powered mechanism and automatically locked in the closed position and in which the gate is powered to an open position and automatically unlocked when being shifted to the open position.

It is yet another object of the present invention to provide a gate opening and closing assembly of the type stated which can be manufactured at a relatively low unit cost but which is highly efficient and reliable in its operation.

It is also an object of the present invention to provide a method of opening and closing hingedly mounted gates and also provide an automatic locking action when the gates are shifted to a closed position and automatically unlocking the gates when the gates are to be moved to an open position.

With the above and other objects in view, my invention resides in the novel features of form, construction, arrangement and combination of parts presently described and pointed out in the claims.

BRIEF SUMMARY OF THE DISCLOSURE

A gate opening and closing apparatus for shifting a gate hingedly mounted on one of its sides, in particular, a vertical side, so that an opposite vertical side thereof is moved to a closed position with respect to a stationary structure or to an open position with respect to the stationary structure. In this case, the stationary structure may represent another wall which is located so that the free vertical side of the gate can be located in proximity to the structure when in the closed position.

The gate opening and closing apparatus of the present invention is designed to automatically move the gate to the closed position and from the closed position to the open position by a powered mechanism and to also provide an automatic locking action when in the closed position and an unlocking action when the gate is moved from the closed position to the open position.

The apparatus comprises a shiftable member operatively mounted with respect to the gate so as to be movable toward and away from the two vertically disposed sides of the gate. In this case, the shiftable member may adopt the form of a plate which is shiftable on the gate itself.

The apparatus of the present invention also includes a shiftable rod means which is operatively pivotally connected to the shiftable plate and to a motor means, as for example, an electric motor. Upon actuation of the motor means, or energization of the electric motor, the rod means shifts the gas to or from the open position to the closed position or from the closed position to the open position. In this case, the shiftable rod means will shift the gate toward the stationary structure when the motive means is actuated and also away from the stationary structure when the motive means is actuated. The rod means may be in the form of a pair of rods with one of the rods being pivotally coupled to the motor and the other of the rods being pivotally coupled to the shiftable plate.

The gate apparatus includes the automatic locking means which is operable in response to movement of the gate to the closed position and to the open position. In this case, the locking means includes a locking rod which is operatively connected to the shiftable plate and is movable therewith toward the stationary structure. Further, the locking rod cooperates with a cooperating locking element and is engageable therewith to lock the gate when the gate has reached the closed position. Thus, the locking means is automatically actuable to lock the gate when the gate reaches the closed position.

The cooperating locking element may adopt the form of an opening or eyelet, often referred to as a "dead eye", in order to receive the locking rod when the latter has been shifted transversely with respect to the gate so as to fully lock the gate when it is in the closed position. Otherwise, the locking rod may operate another mechanism which is movable and thereupon shifts a member into a locking position. In still another embodiment, the locking mechanism may be a ratchet type lock.

In one embodiment of the present invention, the locking rod is shiftable with the shiftable member to the locking position, just after the gate has reached the closed position. Thus, a stop may be located at the closed position, that is, at the stationary structure, in order to limit the movement of the gate. In this embodiment, the locking rod is actually biased by a spring means to an unlocked position, but is shifted to the locking position through the action of the shiftable member.

In another embodiment of the invention, the locking rod is biased to the locking position before the gate reached the closed position. Thus when the gate reaches the closed position, the locking rod engages the cooperating locking means to lock the gate. In this embodiment, the locking rod is preferably used with a latch type lock such as a ratchet type locking mechanism. Further, in this embodiment of the invention, the locking rod is biased by a spring means to the locking position.

In either of the embodiments of the invention as aforesaid, the locking rod is automatically moved to the unlocked position just prior to the movement of the gate to the open position from the closed position. This is accomplished by the rod means moving the shiftable member which also causes the locking rod to be retracted and thereby unlock the gate.

In one aspect of the invention, a pivot means is provided for pivotally coupling the second of the rods to the plate through an elongate diagonally located slot in the plate. This rod means is movable through an arc upon actuation of the electric motor to shift the gate from the open position to the closed position or from a closed position to the open position. The pivot means also moves in the elongate slot when the gate reaches the closed position. This diagonal elongate slot is located so as to allow for any non-linearity in the positioning of the motive means and the rod means with respect to the gate. Further, in one of the preferred aspects of the invention, a pair of angularly disposed slots are provided so that the motive means could be accommodated relative to the position of the gate for any desired installation.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
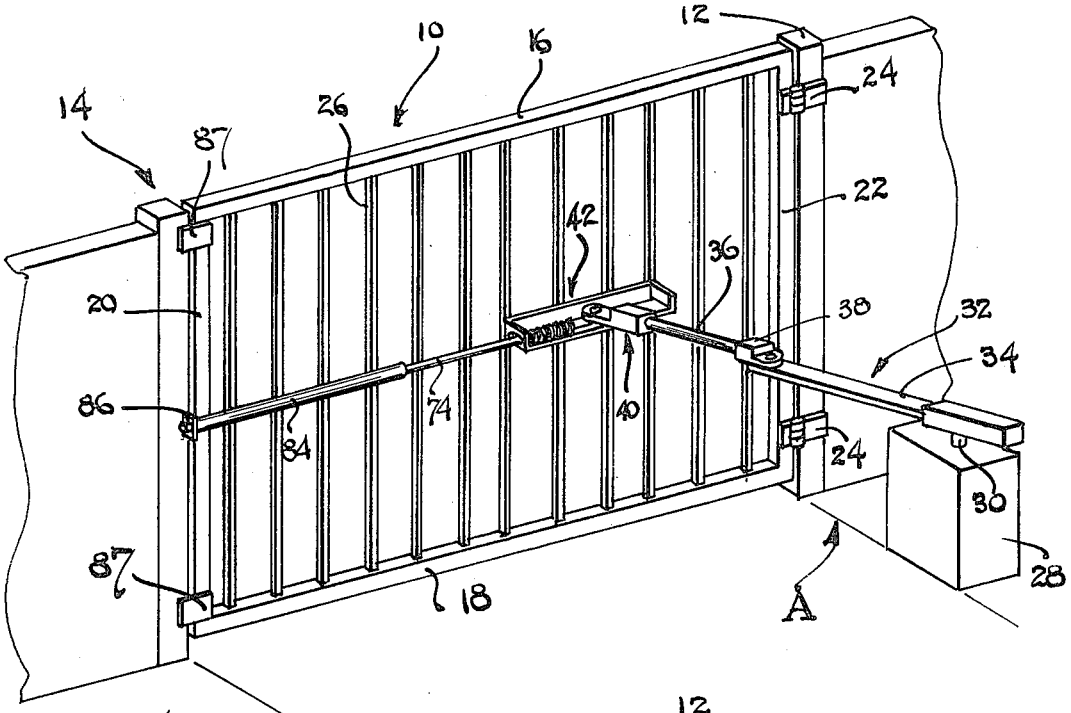
Figure 2:
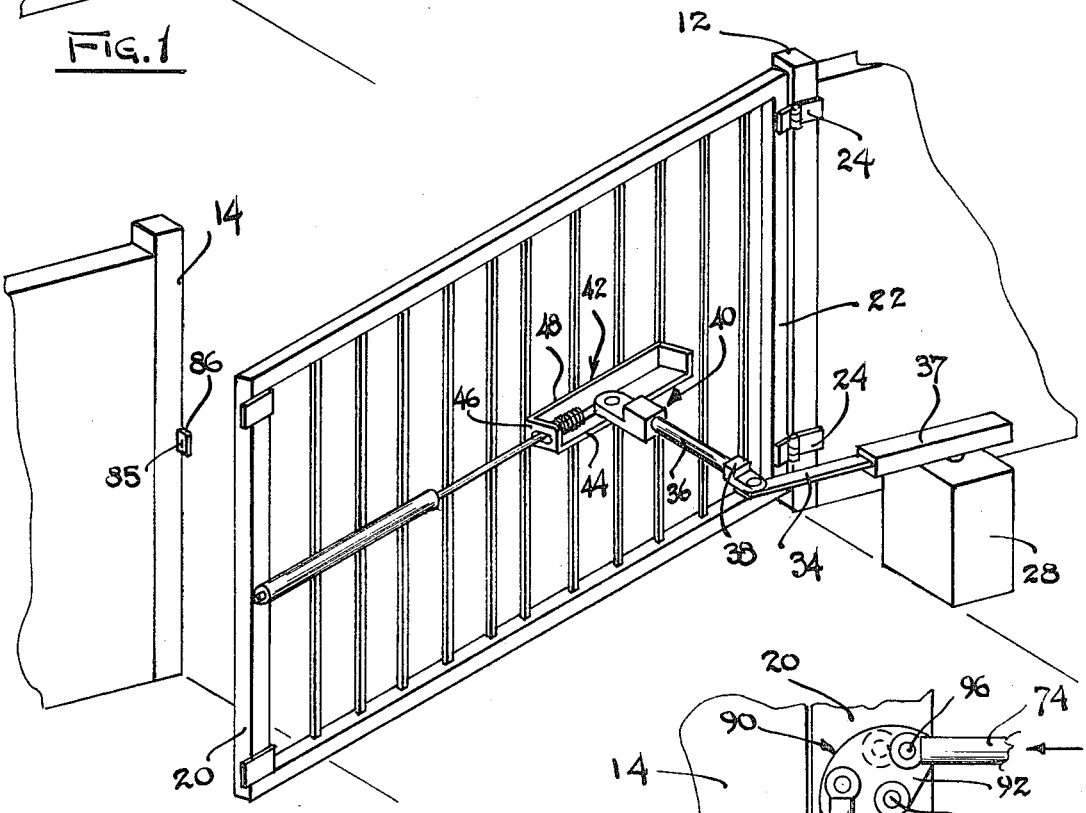
Figure 8:
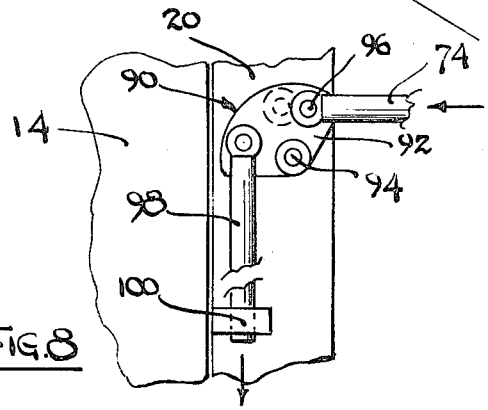
Figure 3:
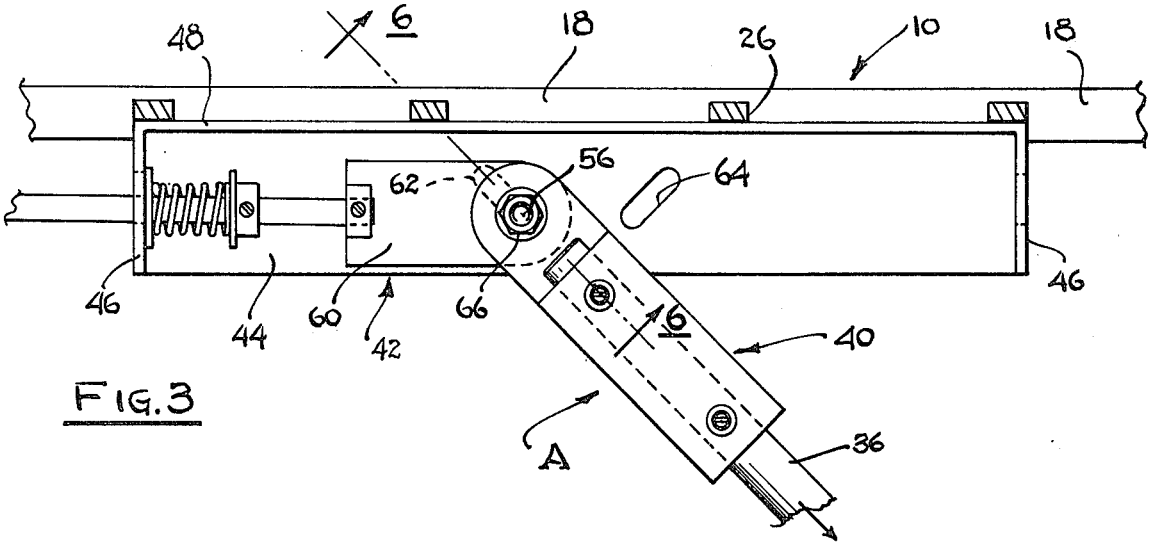
Figure 4:
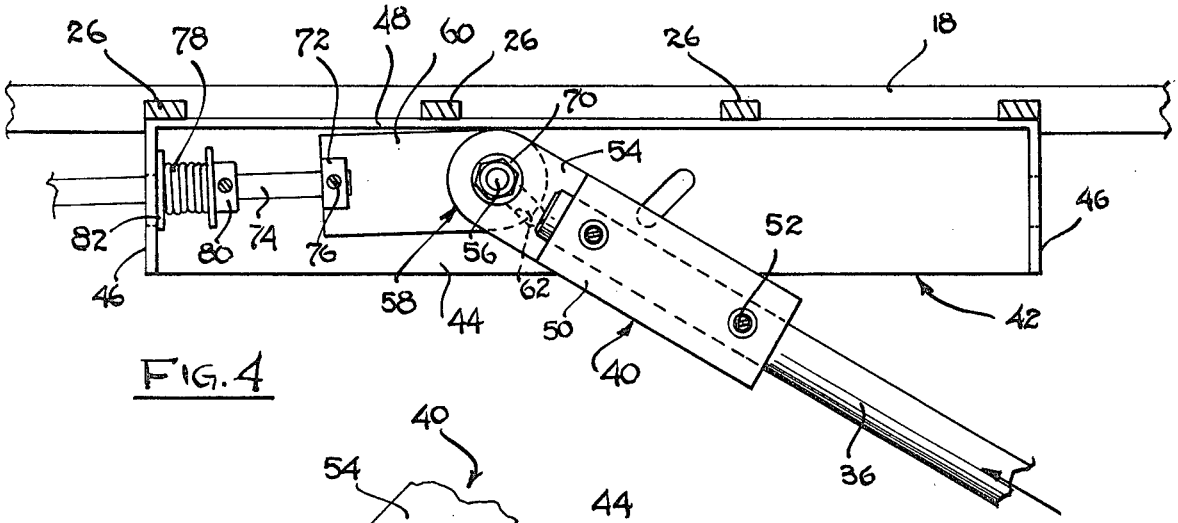
Figure 5:
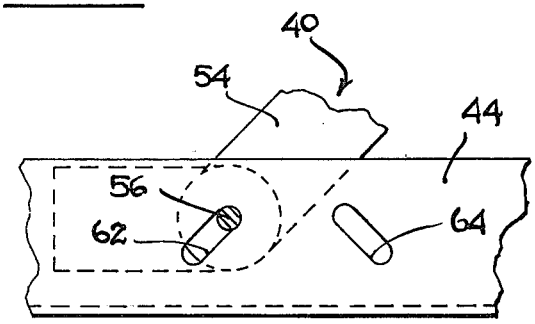
Figure 6:
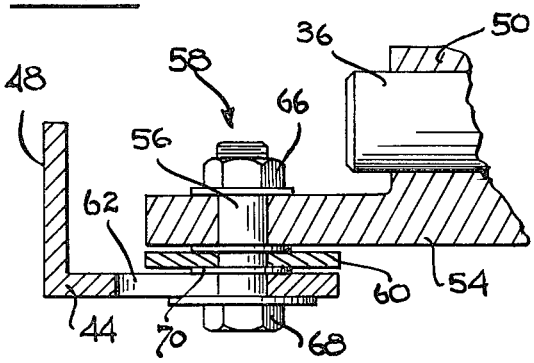
Figure 7:
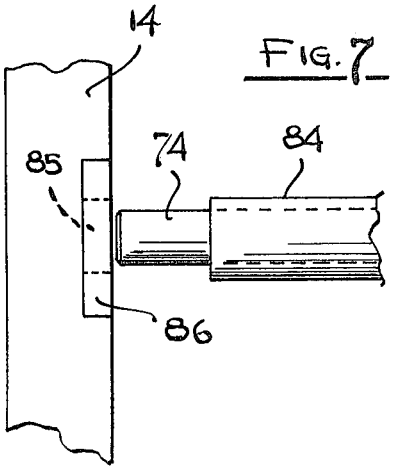
Figure 9:
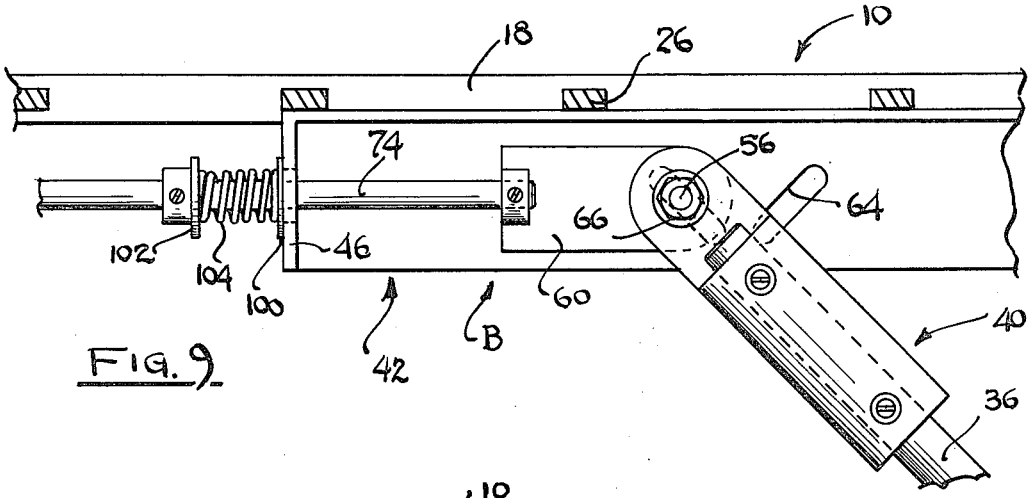
Figure 10:
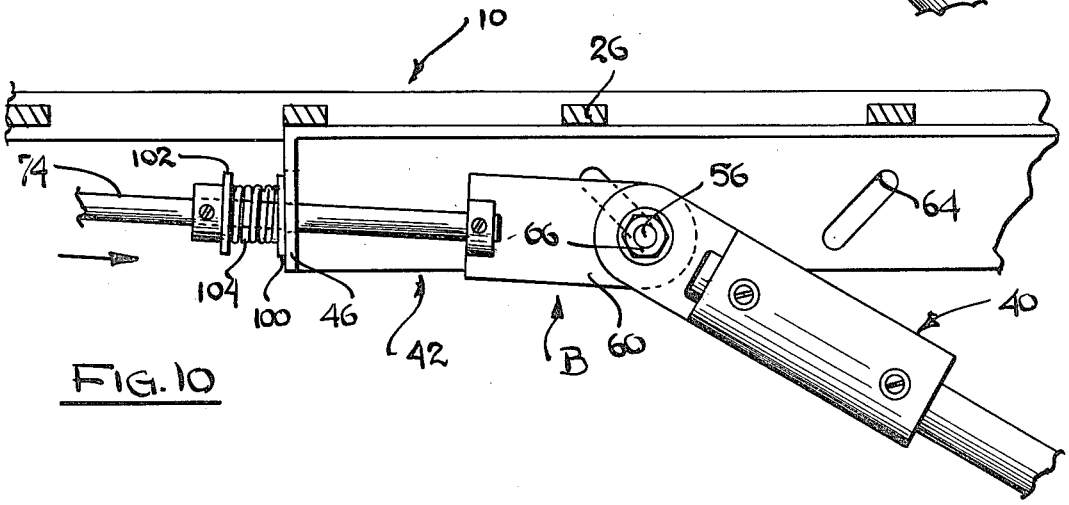
Figure 11:
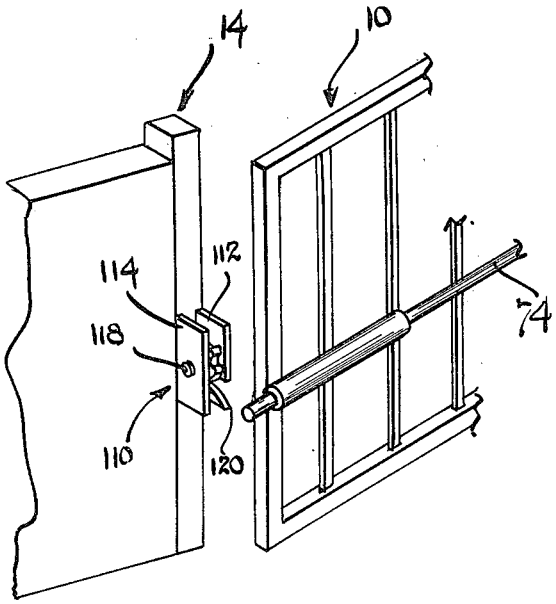
Figure 12:
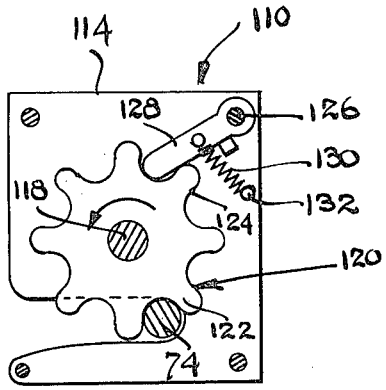

Having thus described the invention in general terms, reference will now be made to the accompanying drawings in which:

FIG. 1 is a perspective view of a gate opening and closing assembly constructed in accordance with and embodying the present invention, and showing the gate in a closed position;

FIG. 2 is a perspective view of a gate opening and closing assembly, somewhat similar to FIG. 1, and showing the gate at least in a partially open position;

FIG. 3 is a top plan view of a portion of a gate opening and closing apparatus used for shifting a gate from an open position to a closed position and from a closed position to an open position and which is constructed in accordance with and embodies the present invention;

FIG. 4 is a top plan view, somewhat similar to FIG. 3 and showing the apparatus of FIG. 3 when the gate has been shifted to the closed and locked position;

FIG. 5 is a bottom plan view of a portion of the mechanism shown in FIG. 3 and FIG. 4;

FIG. 6 is a fragmentary vertical sectional view taken along lines 6—6 of FIG. 3;

FIG. 7 is a fragmentary side elevational view showing a portion of a locking means which is used for locking the gate in the closed position;

FIG. 8 is a fragmentary side elevational view showing a modified form of locking mechanism which may be used with the gate opening and closing assembly of the present invention;

FIG. 9 is a fragmentary top plan view of a modified form of an apparatus constructed in accordance with and embodying the present invention and showing the apparatus where the locking rod forming a part thereof is in the locking position;

FIG. 10 is a fragmentary top plan view, similar to FIG. 9 and showing the apparatus of FIG. 9 in the position where the locking rod forming a part thereof is shifted to an unlocked position;

FIG. 11 is a fragmentary perspective view, broken away and showing the modified form of apparatus of the present invention; and FIG. 12 is a side elevational view, partially broken away and showing an embodiment of a cooperating locking mechanism forming part of the present invention.

DETAILED DESCRIPTION OF PRACTICAL EMBODIMENTS

Referring now in more detail and by reference characters to the drawings which illustrate practical embodiments of the present invention, A designates a gate opening and closing apparatus operable in connection with a gate 10 hingedly mounted on a hinge post 12 so that it is movable with respect to a stationary structure 14, such as a stationary post.

In the embodiment as illustrated, the gate 10 comprises top and bottom longitudinally extending rails 16 and 18 connected at their ends by vertically extending rails 20 and 22, the rail 20 defining a freely movable side of the gate, and the rail 22 defining another side, which is hinged by means of hinges 24. Further, the gate 10 is provided with a plurality of vertically extending longitudinally spaced apart rails 26 in a conventional manner.

The gate opening and closing apparatus A generally comprises a motive means, such as an electric motor 28, located with respect to the gate 10 and which includes a drive shaft 30. A shiftable rod means 32 is connected to the drive shaft 30 and is comprised of a first rod 34 and a second rod 36. The first rod 34 is provided with an enlarged mounting block 37 often called an "elbow" and which is connected to and movable with the drive shaft 30 for arcuate movement with the drive shaft 30. The rod 36 is pivotally connected to the rod 34 through a coupling 38, much in the manner as illustrated in FIG. 1. Further, the rod 36 is provided at its end in proximity to the gate 10 with a mounting block 40 hereinafter described in more detail.

Fixedly mounted on the gate 10 is a horizontally disposed fixed member 42, in the form of a retaining bracket, including a horizontally disposed wall 44 and longitudinally spaced apart vertically extending end walls 46 along with a back wall 48. The fixed member or bracket 42 may be welded to or otherwise rigidly affixed to the gate 10 by any conventional means.

The mounting block 40 is comprised of a housing 50 having an internally threaded bore to receive one end of the rod 36 and which is physically retained therein by means of a retaining screws 52. In this way, the overall length of the rod 36 can be effectively adjusted by threadedly positioning the rod 36 in the bore and retaining same with the screws 52. This allows the two rods 34 and 36 to be adjusted so that they can be perfectally aligned to provide a "dead center" lock arrangement. In this respect a means (not shown) could be employed to provide the rods from going over the dead center position which would release any locking arrangement by virtue of the two rods being aligned.

The housing 50 is provided with an outwardly struck flange 54 for receiving a bolt 56 forming part of a pivot means 58, in a manner to be hereinafter described in more detail. Mounted on the bracket 42 is a shiftable member, often referred to as a shiftable plate 60 and which is capable of generally longitudinally shiftable movement between the vertically disposed rails 20 and 22. The shiftable plate 60 is located on the upper surface of the horizontally disposed bottom wall 44 forming part of the bracket 42, much in the manner as illustrated in FIGS. 3, 4 and 6 of the drawings.

The bracket 42, and particualrly the bottom wall 44 thereof, is provided with the elongate slot 62 which may be aligned with the rod 36, for at least a relatively short portion of its movement. In this case, it can be observed that the slot 62 is angularly located with respect to the path of movement of the plate 60. In a preferred embodiment, the bottom wall 44 of the bracket 42 is similarly provided with another elongate slot 64 and which is angularly located with respect to the slot 62 and preferably perpendicularly located with respect to the slot 62, for reasons which are hereinafter described in more detail.

The pivot means 58 comprises the bolt 56 as aforesaid which is provided with a nut 66 at its upper end and a similar nut 68 at its lower end. In addition, washers 70 are disposed on opposite sides of the shiftable plate 60. In this way, the pivot means 58 is capable of moving in the elongate slot 62 when the rod 36 is shifted in order to move the gate 10 to the closed position or otherwise, to the open position, in a manner to be hereinafter described in more detail.

By further reference to FIG. 1, it can be observed that when the shiftable rod means, including the rods 34 and 36 have moved the gate to the closed position they are generally in a straight line so as to form a positive locking action with respect to the motor 28 against the gate 10 and thereby hold the gate 10 in a locked position. Moreover, when the motor 28 is energized so as to open the gate 10, the rods 34 and 36 move somewhat in arcuate paths in order to accomplish the movement from the closed position to the open position. This movement is of course accomplished through at least the elbow 38.

When the motor 28 is energized to open the gate 10, the arm 34 will rotate in a counter-clockwise direction with respect to the motor 28 and when the motor 28 is energized to shift the gate to the closed position, the arm 34 will rotate in a clockwise direction creating a corresponding but clockwise movement with respect to the arm 36. In this respect, the motor 28 could be a bi-directional motor, that is one which operates in a forward direction or otherwise a reverse direction to open the gate, and the opposite of the said direction in order to close the gate. Notwithstanding, the arrangement connecting the motor 28 to the arms 34 and 36 could be such that the motor could rotate the drive shaft 30 for 360° in order to move the gate to the open position and thereafter another 360° or similar arcuate movement in order to shift the gate to the closed position. The motor normally would be provided with a microswitch located to turn the motor off when the gate has reached the fully closed position or when the gate has reached the fully open position.

It should be understood in connection with the present invention that the motor 28 may be operable by means of any switch mechanism which may adopt the form of a manually actuable switch located to be operated by a party desiring to open and close the gate. In this same respect, and for security purposes, the manually operable lock mechanism could be a security-type key operated lock mechanism. In addition, the motor 28 could, of course, be operated by suitable remote control mechanisms, as for example, a radio receiver and transmitter system, of the type described above.

As indicated previously, when the two arms 34 and 36 have been shifted to move the gate 10 to the closed position, they are generally in a straight line, thereby providing a positive locking action. In addition, the arm 36 is operatively pivotally connected to the plate 60 through the bolt 56 which also passes through an elongate slot 62 formed within the bracket 42. This allows for some non-linearity in the positioning of the motor 28 and hence the respective arms 34 and 36 with respect to the gate 10. Thus, in order to compensate for any non-linearity, the elongate slot 62 is available in order to permit the rod 36 to shift some slight distance in a linear path, when the rods 34 and 36 have been aligned but still require further movement in order to shift the gate 10 to the fully closed position.

In a preferred embodiment of the present invention, the bracket 42 is similarly provided with an elongate slot 64 which is angularly located with respect to slot 62 and preferably perpendicularly located with the slot 62, as aforesaid. In this way, the motive means as for example the electric motor 28, may be positioned on the opposite side of the gate opening and closing apparatus A and particularly the bracket 42. Thus, if the gate were to open from the right-hand side that is, where the rail 22 is located and which was to be hingedly located with respect to the rail 20, then the gate opening and closing assembly would be connected to the gate such that the pivot mean 58 was pivotally connected through the elongate slot 64, much in the same manner as it is connected through the elongate 62.

In this respect, it should be understood that although two such elongate slots have been shown in connection with the present invention, a number of elongate slots could be provided at different angular locations. In this way, the motive means and the connecting mechanism as well, including the connecting rods 34 and 36 could be located initially in any desired position with respect to the gate.

The plate 60 is shiftable along the bottom wall 44 of the bracket 42, generally between the pair of upstanding end walls 46. FIG. 3 illustrates the position of the plate 60 when the gate is in the open position and FIG. 4 illustrates the position of the plate 60 when the gate has been shifted to the closed position. In this case, the plate 60 is provided with an aparture to receive the bolt 56, much in the manner as illustrated in FIG. 6 of the drawing. However, the aperture in the plate 60 is not elongate such that any movement about the bolt 56 will not cause a corresponding generally longitudinal movement of the plate 60.

Secured to the left-hand end of the plate 60, reference being made to FIGS. 3 and 4, is an upstanding boss 72 which retains one end of a longitudinally extending locking rod 74 by means of a set screw 76 within the boss 72. The locking rod extends through an opening in the end wall 46 of the bracket 42 and is biased to the right, reference being made to FIG. 4 that is, toward the hinged end of the gate 10, by means of a compression spring 78. By further reference to FIGS. 3 and 4, it can be observed that the compression spring 78 is captured between a flanged collar 80 on the locking rod 74 and a washer 82 disposed against the upstanding wall 46 of the bracket 42, much in the manner as illustrated in FIGS. 3 and 4. In accordance with this construction, the locking rod 74 is always biased to the unlocked position.

When the gate 10 is being moved to the open position such that the arms 34 and 36 are being angulated with respect to each other, much in the manner as illustrated in FIG. 2, the plate 60 is shifting to the right or toward the hinged end of the gate. In this way, the compression spring 78 will bias the locking rod 74 back from a locked position. Contrariwise, when the gate is being shifted to the closed position, the arm 36 will force the plate 60 toward the left and hence this will cause the locking rod 74 to be moved toward the locked position and the spring 78 will become compressed. In actuality the plate 60 does not really move until the gate reaches the fully closed position. At this point the continued pressure exerted by the arms 34 and 36 as they come into alignment caused the translation of the plate 60 with guiding by the bolt 56 in the diagonal slot 62. This provides the resultant transverse movement of the rod 74.

In the same respect, it should be observed that the plate 60 does not follow a true linear path, but rather is shifted slightly in a skewed position with respect to the true longitudinal dimension. For this purpose the end plates 46 of the bracket 42 would be provided with slots as opposed to a circularly shaped aperture, to accommodate the skewed movement of the plate. The rod 74 can deflect somewhat due to the length thereof but it might be more efficient to provide a pivotal connection at the boss 72 in some cases.

The left-hand end of the locking rod 74, reference being made to FIGS. 1 and 2, extends through a sleeve 84 mounted on the bars 26 of the gate 10. Moreover, the rod 74 has a locking end which is capable of extending through an opening 85 in a corresponding locking element such as a tab 86 on the post. In this way, it can be observed that when the gate 10 is shifted to the closed position, the locking rod 74 will automatically shift to the left and into the aperture 85 of the locking tab 86. For this purpose, the gate would be provided with one or more stop plates 87 to engage the post 14 and thereby prevent the gate from swinging beyond the fully closed position. Further, by virtue of this construction, the gate cannot be unauthorizedly opened inasmuch as the arms 34 and 36 are retained in the locked position since they are generally parallel to one another. Thus, in an attempt to unauthorizedly open the gate, the user would be required to jam the motor 28 or otherwise break the arms 34 and 36 in some fashion in order to permit the locking rod 74 to be removed from the aperture 85 in the tab 86. A sty plate (not shown) is preferably mounted on the post 14 to resist further movement of the gate when it reaches the closed position and thereby permit the locking rod to more laterally to engage the tab 86.

FIG. 8 illustrates a modified form of cooperating locking mechanism 90 which operates with the locking rod 74. In this case, the cooperating locking mechanism 90 is illustrated as being mounted on the rail 20. The cooperating locking mechanism comprises a rocker plate 92 which is rockably mounted on the rail 20 by means of a pin 94. One end of the locking rod 74 is pivotally connected to the rocker plate 92 by means of a pivot pin 96. Also pivotally connected to the rocker plate 92 is another depending rod 98 movable through a boss 100 also mounted on the post 14. The lower end of the arm 98 would be adapted to extend into a recess or through an aperture in a fixed member in order to physically lock the gate 10 with respect to the post 14. When the gate 10 is shifted to the open position, the locking rod 74 would be shifted to the right, thereby permitting the rocker plate 92 to rotate about the pin 94 in a clockwise direction. As this occurs, the rod 98 is pulled upwardly from the locked position thereby permitting the gate to be unlocked and simultaneously moved to the open position. It should be understood that the locking mechanism as illustrated in FIG. 8 is not the only form of locking mechanism which could be used with the gate opening and closing apparatus of the present invention.

FIGS. 9–12 illustrate a modified form of gate opening and closing apparatus B constructed in accordance with and embodying the present invention. The apparatus B is also designed to hingedly shift the gate 10 so that it is movable with respect to the stationary structure 14, as illustrated. The gate opening and closing apparatus B generally comprises the motor means as for example, the electrical motor 28 and which drives a rod means including the first rod 34 and the second rod 36, the latter being secured to the mounting block 40.

In this embodiment of the invention, a flanged collar 100, and similar to the flanged collor 80 is mounted on the left hand side of the wall 46 forming•part of the bracket 42, reference being made to FIG. 9. Moreover, a washer 102 is located against the exterior side of the end wall 46 and entrapped between the flanged collar 100 and the washer 102 is a compression spring 104, similar to the spring 78. In accordance with this construction, the spring 104 biases the locking rod 74 to the extended position, that is the locking position. In the previous embodiment of the invention, the locking rod 74 was biased to the retracted and/or unlocking position inasmuch as the spring 78 was located on the right-hand side of the end wall 46.

FIG. 9 illustrates the position where the locking rod 74 is biased to a locked position. FIG. 10, on the other hand, illustrates a condition in which the locking rod 74 has been moved to the unlocked position so that the gate may spring from the closed position to the open position. In this embodiment of the invention, the locking rod is essentially normally biased to the extended or locking position. In this way, when the gate reaches the closed position, the locking rod will normally engage a cooperating locking mechanism, as hereinafter described, and automatically lock the gate. Thus, there is no need for a stop at the stationary structure in order to limit the movement ofthe gate as it moves to the closed position.

In this latter embodiment of the invention, as in the previously described embodiment of the invention, the locking rod is always biased to move to the retracted or unlocking position as the gate starts to move from the closed to the open position. This results from the fact that the shiftable mechanism shifts to the right, reference being made to FIGS. 9 and 10 and also to FIGS. 3 and 4. Thus, as the shiftable member does shift to the right, the mounting block 40 will start to move within the elongate slot thereby causing the locking rod 74 to retract. In this way, the gate is always free to move to the open position as soon as the motor is energized to move the gate to the open position.

FIG. 11 illustrates the gate being shifted from the open position to the closed position. In this case, it can be observed that the locking rod 74 is extended so as to be engagable with the cooperating locking mechanism. The cooperating locking mechanism may adopt the form of a latch or ratchet type lock such as illustrated in FIGS. 11 and 12. The term "rachet type" lock or "latch type" lock is used in a generic sense to cover all forms of locks which receive a locking pin or similar locking member automatically so as to lock, and which requires some positive action, such as withdrawal of the locking pin in order to permit opening thereof.

The present invention contemplates a highly effective but relatively inexpensive form ratchet type locking mechanism which is more fully illustrated in FIG. 12 of the drawings. In this case, the locking mechanism is designated by reference number 110 and comprises a pair of spaced apart plates 112 and 114 which are provided with an elongate somewhat horizontally disposed slot 116 to receive the end of the locking rod 74, in the manner as hereinafter described in more detail.

Extending between the plates 112 and 114 is a pivot pin 118 which carries a ratchet wheel 120, often referred to as a star wheel. In this case, the pivot pin 118 is preferably suitably journaled within bearings located on the interior surfaces of the plates 112 and 114. The ratchet wheel 20, which is often referred to as a star as aforesaid, is suitably cast from a piece of metal with a plurality of outwardly extending fingers 122 with each separated by intermediate grooves 124. Also extending between the two plates 112 and 114 is a pivot pin 126 which pivotally carries an arm 128. In this case, it can be observed that the arm 128 is so located so as to extend into the various grooves 124. In addition, the arm 128 is biased in the clockwise direction, reference being made to FIG. 12 by means of spring 130 the latter being secured to a pin 132 connected to one of the plates, such as the plate 112.

By virtue of the above outlined construction, it can be observed that the arm 128 which is biased downwardly, will always permit the ratchet wheel 128 to rotate only in the counterclockwise direction. Thus, the locking arm 76 is permitted to enter into one of the grooves 124 as the gate is shifted to the closed position and as the locking arm enters the slot 116. The arm 76 actually "ratchets" the ratchet wheel 120 for one groove 124 and is thereby locked since the ratchet wheel is restrained from rotating in the opposite direction. However, in order to be released from the groove 124 it is necessary to retract the locking arm in the manner as previously described.

The components forming part of the apparatus of the present invention are preferably made of structural metals such as steel or the like. However, it should be understood that the components forming part of the apparatus could be made from a wide variety of structural materials including plastics, and in particular reinforced plastic composites or the like.

The term "gate" as used herein is used in the generic sense to include doors and like structure and essentially constitutes any movable framework or structure which controls the entrance or exit through an access opening to provide a passage way.

Thus, there has been illustrated and described a unique and novel gate opening and closing apparatus and a method of using same which provides for automatically locking a gate when the gate is shifted to the closed position and automatically unlocking the gate when it is shifted from the closed to the open position, and which therefore fulfills all of the objects and advantages sought therefore. It should be understood that many changes, modifications, variations and other uses in applications will become apparent to those skilled in the art after considering this specification and the accompanying drawings. Therefore, any and all such changes, modifications, variations and other uses in applications which become apparent to those skilled in the art after considering this specification and the accompanying drawings are deemed to be covered by the invention which is limited only by the following claims.

Having thus described my invention, what I desire to claim and secure by Letters Patent is:

1. A gate opening and closing apparatus for shifting a gate hingedly mounted on one of its sides so that an opposite side thereof is moved to a closed position with respect to a stationary structure or to an open position with respect to said stationary structure, said apparatus comprising:

(a) a fixed member operatively mounted on said gate,

'(b) a shiftable plate carried by said fixed member and which plate is movable generally in a path extending between the opposite sides of said gate, said shiftable plate also having an elongate slot with an axis angularly disposed with respect to said path, (c) a shiftable rod means operatively coupled to a motive means, (d) pivot means pivotally coupling said rod means to said plate through said a elongate slot, said rod means movable through an arc upon actuation of said motive means to shift said gate from an open position to a closed position or from a closed position to an open position, said rod means also causing said pivot means to move in said elongate slot at least when said gate starts to move from the closed position to the open position, and (e) locking means operatively connected to said shiftable plate and being movable with said shiftable plate to a locking position so that said gate can be locked when shifted to a closed position, and said locking means being movable with said shiftable plate when said gate starts to shift from the closed position to the open position to thereby unlock said gate.

2. The gate opening and closing apparatus of claim 1 further characterized in that said plate is provided with a second elongate slot angularly disposed with respect to said first slot and capable of receiving said pivot means.

3. The gate opening and closing apparatus of claim 1 further characterized in that said plate is provided with a second elongate slot perpendicularly disposed with respect to said first slot and capable of receiving said pivot means.

4. The gate opening and closing apparatus of claim 1 further characterized in that said locking means comprises:

(a) a locking rod operatively connected to said shiftable plate and being movable therewith toward the stationary structure when the gate reaches the closed position, and (b) a cooperating locking element cooperable with said locking rod and being engagable therewith so the locking rod is extended to lock said gate in the closed position when said gate reaches the closed position.

5. The gate opening and closing apparatus of claim 1 further characterized in that said apparatus comprises electrically operable motive means.

6. The gate opening and closing apparatus of claim 1 further characterized in that said shiftable rod means comprises a first rod operatively pivotally coupled to said motive means, a second rod pivotally coupled to said first rod and pivotally coupled to said shiftable plate through said pivot means.

7. The gate opening and closing apparatus of claim 6 further characterized in that said second rod is angularly disposed to the path of movement of said shiftable plate.

8. The gate opening and closing apparatus of claim 1 further characterized in that said rod means causes said pivot means to move in said elongate slot to shift the locking means to the locking position when the gate reaches or is almost in the closed position.

9. The gate opening and closing apparatus of claim 1 further characterized in that said rod means causes said pivot means to move in said elongate slot to shift the locking means to the locking position before the gate has reached the closed position.

10. A gate opening and closing apparatus for shifting a gate hingedly mounted on one of its sides so that an opposite side thereof is moved to a closed position with respect to a stationary structure or to an open position with respect to said stationary structure, said apparatus comprising:

(a) a shiftable member operatively mounted with respect to said gate so as to be movable toward and away from said side of said gate which is not hingedly mounted, (b) shiftable rod means operatively pivotally connected to said shiftable member and to a motive means so that upon actuation of said motive means said rod means shifts said gate to or from the open and closed positions, said shiftable rod means comprising a first rod operatively pivotally coupled to said motive means, a second rod pivotally coupled to said first rod and pivotally coupled to said shiftable member, and where said second rod is angularly disposed to the path of movement of said shiftable member, said shiftable member further including a slot therein angularly located with respect to the path of movement of said shiftable member and said rod is pivotally coupled to said shiftable member through a pivot means also movable in said slot, said shiftable rod means also biasing said shiftable member toward said stationary structure when said motive means is actuated to move said gate to the closed position and away from said stationary structure when said motive means is actuated to move said gate to the open position, (c) a locking rod operatively conncted to said shiftable member and being movable therewith so that the locking rod is extended when the gate has moved from the open position to the closed position, said shiftable member being moable away from the stationary structure and said locking rod being retracted at least when the gate starts to move from the closed position to the open position, and (d) a cooperating locking element cooperable with said locking rod and being engagable therewith to lock said gate in the closed position when said gate reaches the closed position and where said locking rod is retracted with movement of said shiftable member and becomes disengaged from the cooperating locking element when the gate starts to shift from the closed position to the open position.

11. A gate opening and closing apparatus for shifting a gate hingedly mounted on one of its sides so that an opposite side thereof is moved to a closed position with respect to a stationary structure or to an open position with respect to said stationary structure, said apparatus comprising:

(a) a shiftable member operatively mounted with respect to said gate so as to be moable toward and away from said side of said gate which is not hingedly mounted and in a path directly between the opposite sides of said gate, (b) a shiftable rod means for moving said gate and which rod means is operatively connected to a motive means, (c) pivot means operatively pivotally connecting said shiftable rod means to said shiftable member to that upon actuation of said motive means said rod means shifts said gate to or from the open and closed positions, said shiftable rod means also moving said pivot means initially in a direction which is angularly disposed to said gate and also simultaneously biasing said shiftable member toward said stationary structure when said motive means is actuated to move said gate to the closed position and away from said stationary structure when said motive means is actuted to move said gate to the open position, (d) a locking rod operatively connected to said shiftable member and being movable therewith so that the locking rod is extended when the gate has moved from the open position to the closed position, said shiftable member being movable away from the stationary structure and said locking rod being retracted at least when the gate starts to move from the closed position to the open position, and (e) a cooperating locking element cooperable with said locking rod and being engagable therewith to lock said gate in the closed position when said gate reaches the closed position and where said locking rod is retracted with movement of said shiftable member and becomes disengaged from the cooperating locking element when the gate starts to shift from the closed position to the open position.

12. A gate opening and closing assembly comprising:

(a) a gate having a pair of opposite sides and hingedly mounted on one of its sides so that an opposite side thereof is movable to a closed position with respect to a stationary structure or to an open position with respect to said stationary structure, (b) a bracket rigidly mounted on said gate, (c) a shiftable member carried by said bracket and operatively mounted with respect to said gate so as to be movable toward and away from said sides of said gate, (d) pivot means mounting said shiftable member to said bracket in such manner that the shiftable member is also movable other than in a path between opposite sides of said gate, (e) electrically operable motive means, (f) shiftable rod means operatively pivotally connected to said shiftable member and to said motive means so that upon actuation of said motive means said rod means shifts said gate to and from the open and closed positions, said shiftable rod means also moving said shiftable member initially in a direction other than between opposite sides of said gate and thereafter toward said stationary structure when said motive means is actuated to move said gate to the closed position and away from said stationary structure when said motive means is actuated to move said gate to the open position, (g) a locking rod operatively connected to said shiftable member and being movable therewith toward the stationary structure when the gate reaches the closed position, (h) biasing means operatively associated with said locking rod to normally bias said shiftable member, and (i) a cooperating locking element cooperable with said locking rod and being engagable therewith to lock said gate in the closed position when said gate reaches the closed position, said locking rod being disengagable from said cooperating locking element when said shitable rod means starts to move the gate from the closed position to the open position.

* * * * *